United States Patent [19]

Coleman

[11] Patent Number: 4,768,675

[45] Date of Patent: Sep. 6, 1988

[54] CONTAINER HAVING A MANHOLE COVER WITH A PRESSURE-VACUUM RELIEF VALVE

[75] Inventor: Clarence B. Coleman, San Leandro, Calif.

[73] Assignee: Fabricated Metals, Inc., San Leandro, Calif.

[21] Appl. No.: 157,660

[22] Filed: Feb. 19, 1988

[51] Int. Cl.[4] ..... B65D 51/16

[52] U.S. Cl. ..... 220/203

[58] Field of Search ..... 220/203, 204, 303, DIG. 32, 220/DIG. 33

[56] References Cited

U.S. PATENT DOCUMENTS

| | | | |
|---|---|---|---|
| 2,152,422 | 3/1939 | Tokheim . | |
| 2,164,450 | 7/1939 | Eshbaugh et al. . | |
| 2,655,284 | 10/1953 | Konchan . | |
| 2,961,410 | 8/1939 | Drane . | |
| 4,005,341 | 1/1977 | Uptegraff, Jr. et al. | 317/15 |
| 4,109,819 | 8/1978 | Kushman et al. | 220/208 |
| 4,339,054 | 7/1982 | Kellogg | 220/295 |
| 4,489,883 | 12/1984 | Anderson | 220/203 |
| 4,498,599 | 2/1985 | Avrea | 220/203 |
| 4,540,103 | 9/1985 | Kasugai et al. | 220/203 |

*Primary Examiner*—George T. Hall

*Attorney, Agent, or Firm*—Jack M. Wiseman

[57] ABSTRACT

A bulk material container in which a manhole cover has a relief valve. The relief valve includes a resilient spacer ring disposed between a valve seat of the relief valve and a valve plate. A spring urges the valve plate of the relief valve toward the valve seat. When the fluid pressure in the container exceeds a predetermined magnitude, the valve plate is lifted away from the valve seat against the urgency of the spring to vent the fluid in the container to atmosphere. A bulk material container in which a manhole cover has a relief valve. Vacuum relief apertures are formed in a backing plate of the relief valve. The vacuum relief apertures communicate with the fluid in the container and atmosphere. A disc closes the vacuum relief apertures until displaced when the fluid pressure of the fluid within the container is less than atmospheric pressure to provide a path for air under atmospheric pressure to flow into the container through the vacuum relief apertures.

23 Claims, 3 Drawing Sheets fig_4
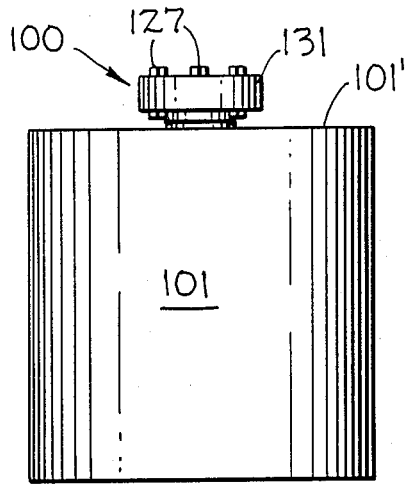
fig_5
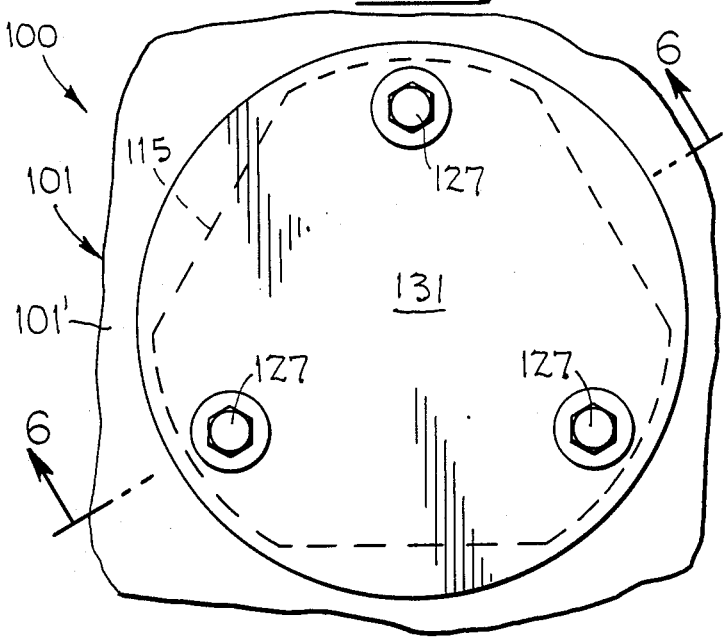
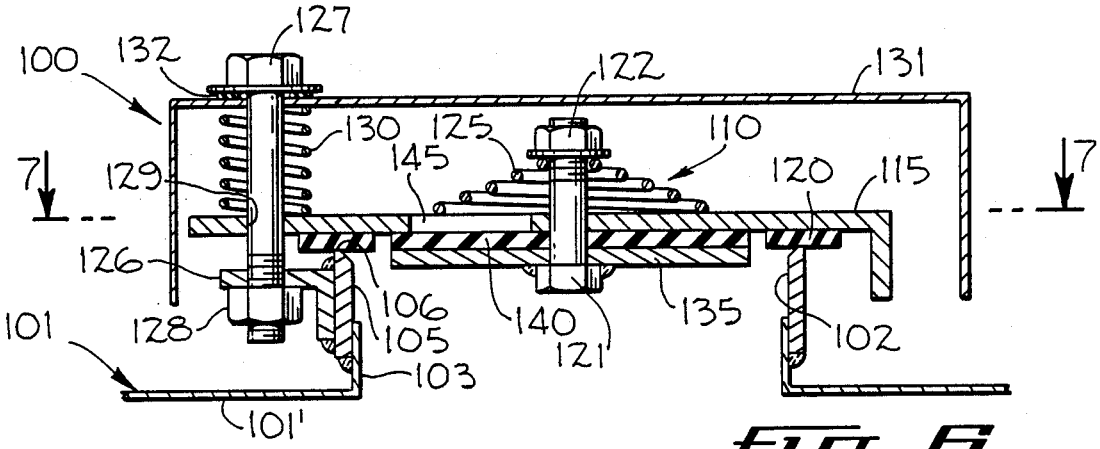
fig_6
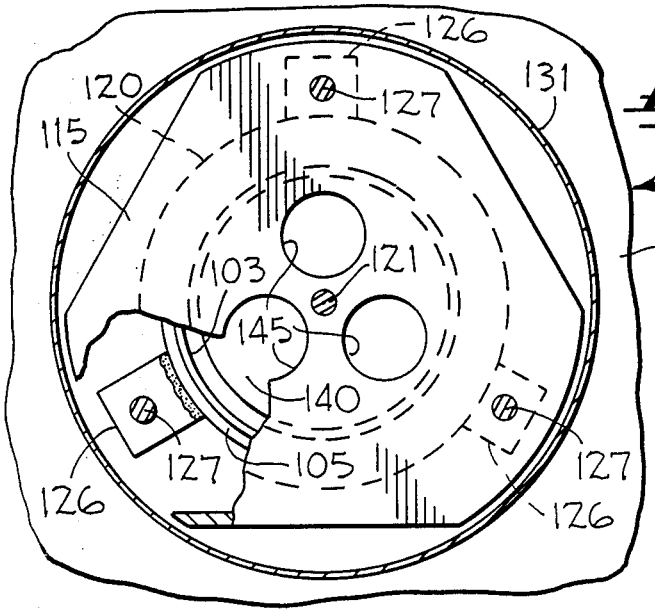
fig_7

CONTAINER HAVING A MANHOLE COVER WITH A PRESSURE-VACUUM RELIEF VALVE

BACKGROUND OF THE INVENTION

The present invention relates in general to a bulk material container or tank having a manhole cover, and more particularly to a bulk material container or tank having a manhole cover with a pressure-vacuum relief valve.

It is desirable to provide manhole covers for bulk material containers with a pressure-vacuum relief valve. When the fluid pressure within the container or the tank is excessive, the pressure valve of the relief valve of the manhole cover opens to vent the fluid pressure of the fluid within the container or tank to atmosphere. When the fluid pressure of the fluid within the container or the tank is less than atmospheric pressure, the vacuum relief passage of the relief valve of the manhole cover provides a path for the ambient air to enter the container or tank.

The application of a restraining force to secure the relief valve to the manhole cover may distort the manhole cover. The distortion of the manhole cover may influence the effectiveness of the relief valve seal or the seating of the valve plate on the valve seat of the relief valve. Thus, distortion of the manhole cover has an effect on the relieving pressure and the re-sealing pressure of the relief valve.

In the employment of a plate valve for a manhole cover of a bulk material container to provide the initial pressure and vacuum relief, there is limited clearance in the opening of the plate valve because the spring constant inhibits the opening of the plate valve. Thus, the volume of the fluid passing through the opening of the plate volume may be insufficient.

In the U.S. Patent to Drane, U.S. Pat. No. 2,169,410, issued on Aug. 15, 1939, for Breather Valve And Hatch For Tanks, there is disclosed a popoff valve plate. When the fluid pressure in the tank is sufficient to lift the valve plate against the urgency of springs, gas escapes from the tank and is vented to atmosphere. When the fluid pressure in the tank is reduced below atmospheric pressure, an inlet valve is unseated to permit air from the atmosphere to enter the tank to lessen the degree of vacuum in the tank.

The U.S. patent to Tokheim, U.S. Pat. No. 2,152,422, issued on Mar. 28, 1939, for Safety Device For Volatile Liquid Storage Tanks discloses a relief valve for a liquid storage tank. The relief valve is surrounded by an annular series of vacuum valves.

In the U.S. patent to Eshbaugh, et al., U.S. Pat. No. 2,164,450, issued on July 4, 1939, for Radiator Pressure Cap, there is disclosed a vacuum cup valve, which unseats one spring in response to a vacuum. The surrounding enclosure of the one spring will elevate from overpressure against another spring.

The U.S. patent to Konchan, U.S. Pat. No. 2,655,284, issued on Oct. 13, 1953, for Radiator Pressure Cap discloses a vacuum relief valve unseating against the urgency of one spring and a pressure relief valve unseating against the urgency of another spring. The U.S. patent to Uptegraff, Jr., et al., issued on Jan. 25, 1977, for Casing Construction For Pole Type Dielectric Containing Transformer discloses an operating stem carried for rotative movement by a bearing gasket secured to the underside of a cover. A spring is carried on the stem.

The U.S. patent to Kushman, et al., U.S. Pat. No. 4,109,819, issued on Aug. 29, 1978, for Explosion Vent And Method Of Venting discloses a quick-release vent for releasing a rapid pressure buildup within a storage bin. The U.S. patent to Kellogg, U.S. Pat. No. 4,339,054, issued on July 13, 1982, for Pressure Relieved Plug And Socket Cleanout Assembly discloses a pressure relief valve mounted in a plug and is manually operated to vent excess pressure from a receptacle.

SUMMARY OF THE INVENTION

A bulk material container or the like having a manhole cover with a pressure relief valve in which a resilient spacer ring is disposed between a valve seat of a pressure relief valve and a support structure for a spring of the pressure relief valve, which spring urges a valve plate of the pressure relief valve toward the valve seat.

A bulk material container of the like having a manhole cover with a vacuum passage in which vacuum relief apertures are formed through a backing plate of the pressure relief valve for the manhole cover, the vacuum relief apertures are adaptable for communicating with the fluid in the container and with the atmosphere, and a disc closes the vacuum relief apertures until displaced when the fluid pressure of the fluid within the container is less than atmospheric pressure, the disc then moves away from the closure state of the vacuum relief apertures to provide a path for the air under atmospheric pressure to flow into the container through the vacuum relief apertures.

An object of the present invention is to provide a bulk material container or the like with a manhole cover having a pressure and vacuum relief valve in which the valve opening is increased beyond the initial opening for pressure and vacuum relief to accommodate an increased volume of fluid.

A plate valve for pressure and vacuum relief may have limited clearance in the initial pressure and vacuum relief, because the constant of a spring does not allow the plate valve to open with a great enough expanse to pass the desired high volume of fluid. By employing a temperature activated pin or bolt, the plate valve moves to increase the valve opening, thus enabling the passing of an increased volume of fluid.

Another object of the present invention is to provide a bulk material container or the like with a manhole cover having a pressure relief valve thereon in which the application of the retaining force to secure the relief valve to the manhole cover does not adversely effect the seating and the sealing of the relief valve.

A feature of the present invention is that a hinge for pivoting the pressure relief valve to the top of the manhole cover can be disposed at any selected location on the top wall of the manhole cover without adversely effecting the seating and sealing of the relief valve.

Another feature of the present invention is the ability to maintain a relatively constant space between the valve seat of a pressure relief valve of the manhole cover and a compression spring support of the pressure relief valve regardless of the distortion of the manhole cover so as not to adversely effect the seating and sealing of the relief valve.

Another feature of the present invention is that a single long lever for a locking mechanism can be employed to apply a restraining force to secure a pressure relief valve to a manhole cover without adversely effecting the seating and sealing of the relief valve.

DESCRIPTION OF THE DRAWINGS

FIG. 4 is an elevation view of another bulk material container with a manhole cover having a modified pressure relief valve embodying the present invention.

FIG. 5 is an enlarged, fragmentary top view of the bulk material container shown in FIG. 4.

FIG. 6 is an enlarged vertical sectional view taken along line 6—6 of FIG. 5.

FIG. 7 is a horizontal sectional view reduced in size taken along line 7—7 of FIG. 6 with a portion thereof broken away.

DESCRIPTION OF THE PREFERRED EMBODIMENTS

Figure 2:
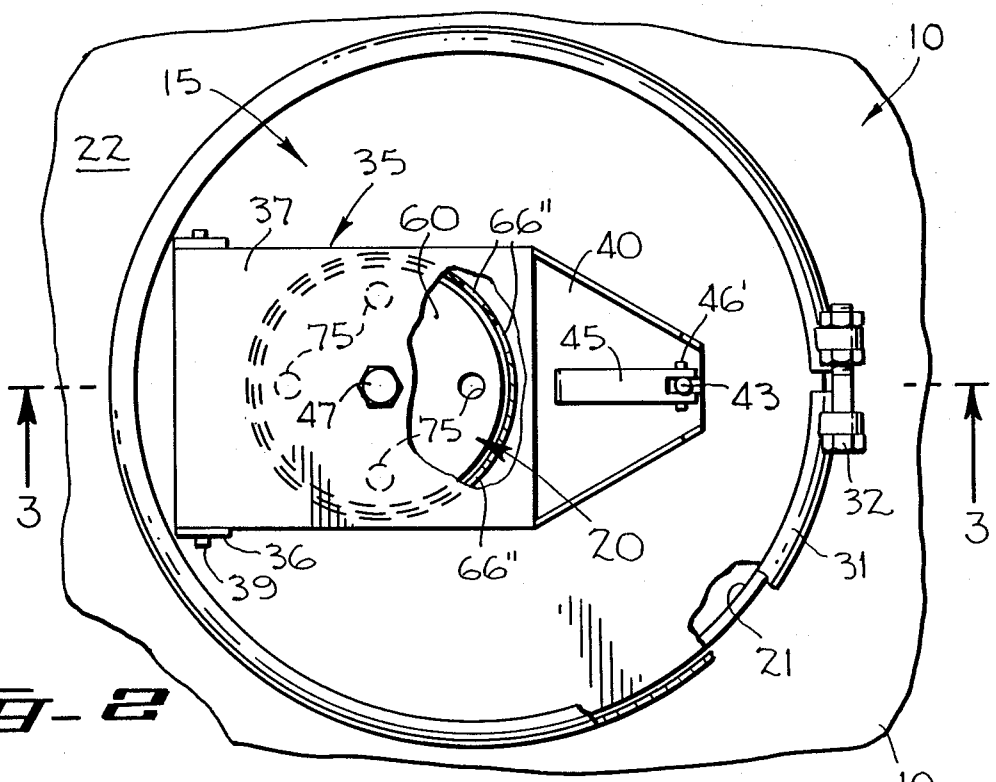
FIG. 2 is an enlarged, fragmentary top view of the bulk material container shown in FIG. 1.
Figure 1:
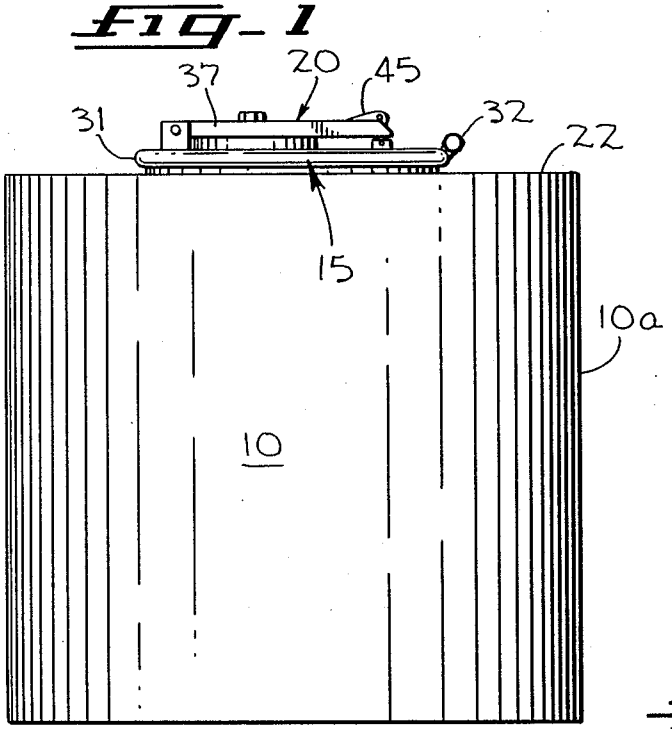
FIG. 1 is an elevation view of a bulk material container with a manhole cover having a pressure relief valve embodying the present invention.
Figure 3:
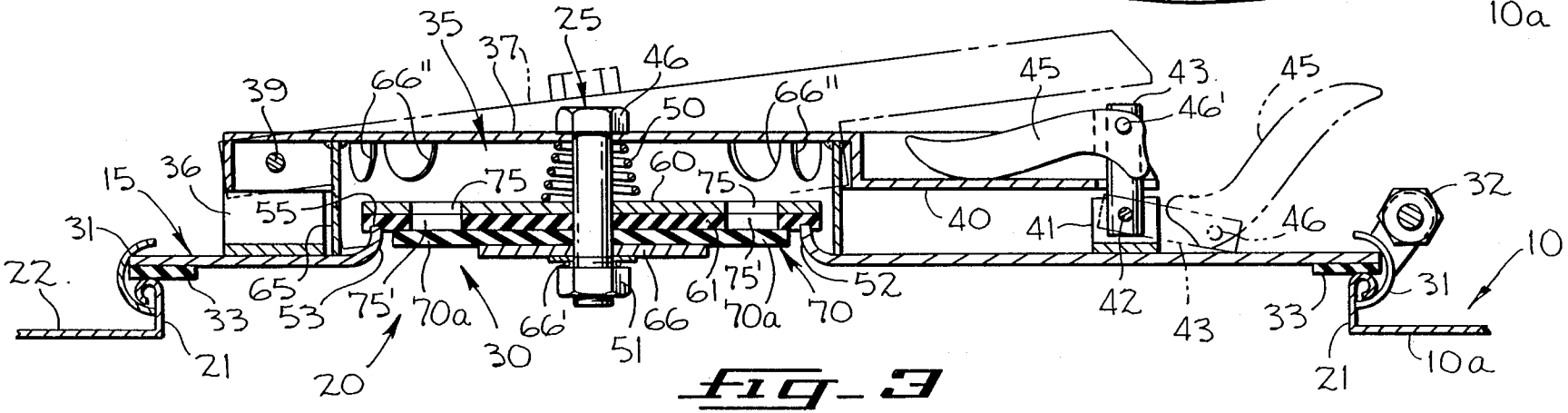
FIG. 3 is an enlarged vertical sectional view taken along line 3—3 of FIG. 2.

Illustrated in FIGS. 1–3 is a bulk material container 10 with a manhole cover 15 having a relief valve 20. The manhole cover 15 is disposed over a manhole opening 21 formed in the top wall 22 of the shell 10*a* of the container 10. The relief valve 20 includes a check or poppet valve 25 which opens to vent fluid pressure of fluid within the shell 10*a* of the container 10 exceeding a prescribed pressure to atmosphere. The relief valve 20 also includes a vacuum vent 30 which opens for air under atmospheric pressure or ambient pressure to flow into the shell 10*a* of the container 10 when the fluid pressure of fluid within the shell 10*a* of the container 10 is less than atmospheric pressure. While the exemplary embodiment makes reference to a container, it is to be understood that the inventive concepts of the present invention are equally applicable to a tanker truck with a manhole cover or a bin with a manhole cover.

In the exemplary embodiment of the present invention, a suitable locking ring 31 secures the manhole cover 15 to the top wall 22 of the container 10 by gripping the wall of the top wall 22 surrounding the manhole opening 21 and by gripping the perimetric wall of the manhole cover 15. In the exemplary embodiment, the lock ring 31 is split so that confronting free ends thereof may be drawn toward one another to tighten the lock ring for gripping relation with the manhole cover 15 and the top wall 22 of the container 10 or may be drawn apart for loosening the lock ring to disengage the manhole cover 15 and the top wall 22 of the container 10 through the action of a nut and bolt arrangement 32. While a nut and bolt arrangement 32 is illustrated, other suitable arrangements may be employed equally as well, such as clamping forms of barrel lock rings. In the exemplary embodiment, gasket ring 33, such as a neoprene, is fixed to the underside of the manhole cover 15 below the perimetric wall thereof and is adapted for sealing engagement with the top wall of the container 10 surrounding the manhole opening 21. While the gasket ring 33 is illustrated as fixed to the manhole cover 15, it is apparent that it can be so fixed by a variety of different well-known procedures or may be shipped loosely in place.

The manhole cover 15 also includes a restraining mechanism or a latch 35 for pivotally securing the relief valve 20 to the manhole cover 15. The latch 35 includes transversely spaced ears 36 which are secured to the top of the manhole cover 15. A latch plate 37 of the latch 35 is formed with a transversely disposed bore therethrough at one end thereof. A pivot pin 39 passes through the ears 36 and the bore formed through the plate 37 formed at the one end of the latch plate 37. Thus, the latch plate 37 is pivotally attached to the manhole cover 15. (See solid and dotted lines in FIG. 3.)

At the other end of the latch plate 37 is a locking flange 40 which is recessed in the latch plate 37. Fixed to the top wall of the manhole cover 15 are transversely spaced ears 41. Pivotally connected to the ears 41 through a pivot pin 42 is a pivotal member 43. At the top of the pivotal member 43 is pivotally attached a bifurcated cam locking lever 45 through a pivot pin 46'. The cam locking lever 45 is pivotally actuated to lockingly engage the recessed locking flange 40 (shown in solid line in FIG. 3) or to release the recessed locking flange 40 from locking engagement (shown in dotted line in FIG. 3).

Formed in the latch plate 37 is a centrally located opening in which is disposed a retaining member or bolt 46 of the relief valve 20. The stem of the bolt 46 receives a compression coil spring 50 of the relief valve 20. A nut 51 is threaded onto the stem of the bolt 46. Formed in the manhole cover 15 is an opening 52 that is surrounded by an annular wall 53. The annular wall 53 defines an annular valve seat 55 for the relief valve 20. Displaceably engaging the annular valve seat 55 is a backing valve plate 60. The underside of the backing valve plate 60, which is adapted to engage the annular valve seat 55, is a resilient spacer sealing ring or gasket 61. In the exemplary embodiment, the resilient spacer sealing ring 61 is made of neoprene and when the sealing ring 61 engages the valve seat 55, there is sealing engagement therebetween.

The compression spring 50 interengages the latch plate 37 and the backing valve plate 60. The nut 51 is disposed below the backing valve plate 60, while the head of the bolt 46 is disposed above the latch plate 37. Secured to the underside of the latch plate 37 by weldments is a reinforcing ring 65. When the latch plate 37 is latched to the manhole cover by the cam latching lever 45, the bottom wall of the reinforcing ring 65 engages the top of the manhole cover 15. Pivotal movement of the latch plate 37 imparts pivotal movement to the reinforcing ring 65.

Formed in the reinforcing ring 65 are angularly spaced openings 66''. When the fluid pressure from the fluid in the shell 10*a* of the container 10 exceeds a predetermined magnitude, the fluid pressure overcomes the urgency of the spring 50. As a consequence thereof, the backing valve plate 60 is moved away from the valve seat 55. Fluid under pressure within the container 10 is vented through the opening 52 and through the openings 66'' to be vented to atmosphere. Thus, the relief valve 20 functions as a pressure relief valve. This action continues until the fluid pressure within the shell 10*a* of the container 10 is below the predetermined magnitude, at which time, the spring 50 urges the backing valve plate 60 into sealing engagement with the valve seat 55.

The fluid pressure at which the backing valve plate 60 is displaced from the valve seat 55 to open the pressure relief valve 15 is determined by the spring constant of the spring 50 and not by the location of the nut 51 on the stem of the bolt 46. More specifically, the pressure exerted by the spring 50 on the plate 60 is a function of the spring constant of the spring 50. The tightening of the nut 51 on the bolt 46 reduces the space between the cover 37 and the seat 55. Hence, the pressure required to lift the plate 60 from the seat 55 is controlled by the constant of the spring 50.

By virtue of the resilient spacer ring 61 between the valve seat 55 and the support structure for the pressure applying spring 50, the space between the support structure for the spring 50 and the valve seat 55 will remain constant when the relief valve 20 is latched to the manhole cover 15 by the restraining action of the latch mechanism 35, regardless of any distortion to the manhole cover 15 by the restraining action in latching the pressure relief valve 20 to the manhole cover 15. The backing valve plate 60 provides the support structure for the coil spring 50. By maintaining the space between the valve seat 55 and the support structure for the spring 50 constant, the adverse effect of the distortion of the manhole cover 15 on the seating and sealing of the backing plate 60 on the valve seat 55 is reduced. Thus, the pivotal connection for the latch plate 37 can be located at various selected places along the manhole cover 15 and the single long cam locking lever 45 can be employed as the locking member.

In order for ambient air or air under atmospheric pressure to enter the shell 10*a* of the container 10 when the fluid pressure from the fluid in the shell 10*a* of the container 10 is less than atmospheric pressure, vacuum relief apertures 75 are formed through the backing valve plate 60 and aligned vacuum relief apertures 75' are formed through the resilient spacer ring 61. The vacuum relief apertures 75 and 75', in the preferred embodiment, are disposed equal angular distances apart and at equal radial distances from the center line of the relief valve 20, as defined by the axes of the bolt 46, the backing valve plate 60 and the spacer ring 61.

Disposed below the spacer ring 61 and above the nut 51 is a rigid vacuum relief backing disc 66 that is received by the bolt 46. A neoprene O-ring 66' is disposed between the nut 51 and the rigid vacuum relief backing disc 66. Disposed between the spacer ring 61 and the rigid vacuum relief backing disc 66 is a yieldable annular flap 70 that is also received by the bolt 46. The nut 51 retains the vacuum relief backing disc 66 and the annular flap 70 in a fixed position along the axis of the bolt 46. The radial distance of the flap 70 is greater than the radial distance of the vacuum relief apertures 75'. The radial extent of the vacuum relief backing disc 66 is great enough to retain the flap 70 firmly in position but insufficient to extend below the vacuum relief apertures 75 or interfere with the flapping action of the marginal perimeter 70*a* of the flap 70. Thus, the marginal perimeter 70*a* of the flap 70 is capable of being displaced away from the spacer ring 61.

When the fluid pressure of the fluid in the container 10 is equal to or greater than atmospheric pressure, the flap 70 is firmly urged against the spacer ring 61 by the fluid pressure in the container 10 to seal the adjacent ends of the vacuum relief apertures 75. When the fluid pressure of the fluid in the container 10 is less than atmospheric pressure, the marginal perimeter 70*a* of the flap 70 is displaced from the spacing ring 61 by the atmospheric pressure exceeding the fluid pressure in the shell 10*a* of the container 10. Thus, air under atmospheric pressure enters the shell 10*a* of the container 10 over the following path to lessen the degree of vacuum in the shell 10*a* of the container 10: openings 66'' of the reinforcing ring 65, space between the latch plate 37 and the backing valve plate 60, vacuum relief apertures 75, and vacuum relief apertures 75'. This action continues until the fluid pressure within the container is at least equal to atmospheric pressure.

The pivotal movement of the latch plate 37 about the axis of the pin 39 imparts pivotal movement therewith to the bolt 46, the spring 50, the backing valve plate 60, the spacer ring 61, the reinforcing ring 65, the vacuum relief backing disc 66 and the flap 70.

Illustrated in FIGS. 4–6 is a bulk material container 100. While the exemplary embodiment discloses a container, it is apparent that the inventive concepts herein employed are equally applicable to truck tanks, bins, or the like. The container 100 includes a shell 101 with top wall 101' in which a manhole opening 102 is formed. An upright section 103 of the top wall 101' surrounds the manhole opening 102. In the exemplary embodiment, a suitable metallic ring 105 is welded to or may be integrally formed with the upright section 103. The upper wall of the ring 105 forms a valve seat 106 for a relief valve 110.

The relief valve 110 includes a backing valve plate 115. Also included in the backing valve plate 115 is an outer resilient valve sealing ring 120. In the preferred embodiment, the outer sealing ring 120 is made of neoprene. The sealing ring 120, when disposed in engagement with the valve seat 106, provides a sealing engagement between the backing valve plate 115 and the valve seat 106.

A bolt 121 is received by a central opening in the backing plate 115. The upper end of the bolt 121 is in threaded engagement with a nut 122. Disposed between the nut 122 and the backing plate 115 is an extension coil spring 125 having a generally conical configuration. The extension spring 125 surrounds the stem of the bolt 121. In the exemplary embodiment, the spring 125 is a 12 oz. spring.

Welded to the other wall of the ring 105 are support members 126. Each support member 126 is in the form of a block or an angle member with a bore therethrough having a threaded wall surrounding the bore. Received by the bores of the support members 126, respectively, are bolts 127. The bolts 127 are supported, respectively, by threaded engagement with the threaded walls surrounding the bores formed in the support members 126. A nut 128 is disposed in threaded engagement with the lower end of each of the bolts 127. The bolts 127 are spaced equal angular distances apart and equal radial distances from the axis of the bolt 121. Peripheral openings 129 are formed in the backing plate 115 in the vicinity of the peripheral edges thereof. The peripheral openings 129 are spaced equal angular distances apart and equal radial distances from the axis of the bolt 121 to receive, respectively, the bolts 127.

Surrounding the stem of each of the bolts 127 is a compression coil spring 130. Each compression coil spring 130 is disposed between the backing valve plate 115 and a cover 131 to urge the outer sealing ring 120 of the backing valve plate 115 to be seated on the valve seat 106 in sealing engagement therewith. In the exemplary embodiment, each compression coil spring 130 is an 8 lb. spring.

The metal cover 131 with a depending flange is disposed over the relief valve 110 and is formed with openings therethrough to receive, respectively, the stem of the bolts 127. A rubber seal 132 is disposed between the cover 131 and the heads of the bolts 127.

When the fluid pressure of the fluid in the shell 101 of the container 100 exceeds a preselected magnitude determined by the urgency of the compression springs 130, a force is applied against the backing valve plate 115 to lift the resilient outer sealing ring 120 away from the valve seat 106 to remove the sealing engagement therebetween. Thereupon, fluid under fluid pressure in the shell 101 of the container 100 in excess of the predetermined magnitude is vented to atmosphere through the space between the valve seat 106 and the outer sealing ring 120. The venting action continues until the fluid pressure within the shell 101 of the container 100 is less than the preselected magnitude.

Welded to the head of the bolt 121 and disposed between the backing valve plate 115 and the head of the bolt 121 is a rigid metallic disc 135. The metallic disc 135 receives the stem of the bolt 121. Fixed to the metallic disc 135 and disposed between the metallic disc 135 and the backing valve plate 115 is an inner sealing ring 140, which is made of suitable material, such as neoprene. The rigid disc 135 maintains the inner sealing ring 140 generally planar. When the outer resilient ring 120 is in sealing engagement with the valve seat 106 and the fluid pressure in the shell 101 is at least equal to atmospheric pressure, the sealing ring 140 is in sealing engagement with the backing valve plate 115.

Formed in the backing valve plate 115 are vacuum relief apertures 145 spaced equal angular distances apart and equal radial distances from the axis of the bolt 121. In the preferred embodiment, there are three vacuum relief apertures spaced 120 degrees apart. The radial extent of the sealing ring 140 is greater than the radial distance of the vacuum relief apertures 145. Thus, the sealing ring 140 under the urgency of the extension spring 125 closes off the vacuum relief apertures 145 while the fluid pressure of the fluid in the shell 101 of the container 100 exceeds atmospheric pressure.

When the fluid pressure of the fluid in the shell 101 of the container 10 is less than atmospheric pressure, air from the atmosphere that has entered the vacuum relief apertures 145 applies a force to the sealing ring 140 and the disc 135 against the urgency of the extension spring 125 to displace the sealing ring 140 from sealing engagement with the backing valve plate 115. The extensible action of the spring 125 permits such a displacement. The compressive action of the springs 130 continues to urge the outer sealing ring 120 into sealing engagement with the valve seat 106. Thus, air under atmospheric pressure enters the shell 101 of the container 100 over the following path to lessen the degree of vacuum in the shell 101 of the container 100 until the fluid pressure within the container 100 is at least atmospheric pressure: vacuum relief apertures 145 and the space between the separated sealing ring 140 and the backing plate 115.

Figure 8:
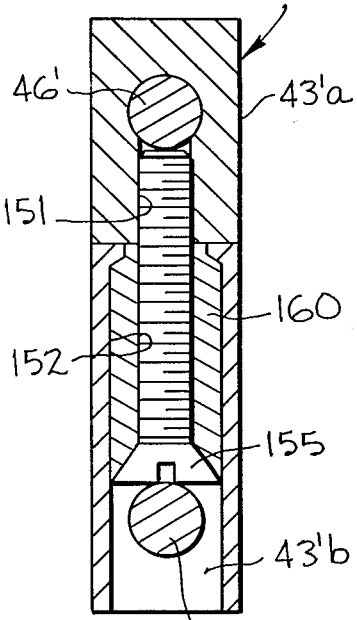
FIG. 8 is a vertical sectional view of a modification of a pivotal member of a latch employed in the bulk material container shown in FIGS. 1–3 under normal operating conditions.

Illustrated in FIG. 8 is a fusible device or a pivotal member 43' for the latch 35 which is a modification of the pivotal member 43 shown in FIGS. 1–3 for the latch 35. The pivotal member 43' is separated into two sections **43'*a* and 43'*b* disposed in contiguous relation. The section 43'*a* receives the pivot pin 46' (FIGS. 2, 3 and 8) and the section 43'*b* receives the pivotal pin 42. Formed in the confronting ends of the sections 43'*a* and 43'*b* are suitable complementary openings 151 and 152. Seated in the openings 151 and 152 is a suitable threaded pin or cap screw 155. The walls surrounding the opening 151 are in threaded engagement with the screw 155 to hold the screw 155 in a fixed position therein. Disposed within the opening 152 about the portion of the cap screw 155 received therein is a melting alloy 160. The melting alloy 160, while solid, holds the screw 155 in a fixed position within the opening 152**.

The screw 155 and the melting alloy 160 serve to maintain the pivotal member 43' in contiguous relation for functioning as a unitary structure in the manner the pivotal member 43 functions as part of the latch 35. The melting alloy 160 is a well-known product commonly used in fusible devices. A supplier of such melting alloys is Federated Metals of Union City, Calif. The melting temperature for the melting alloy 160 may be in the range of 220°–300° F., or any other suitable range. In the exemplary embodiment, the melting alloy 160 melts at 220° F.

Figure 9:
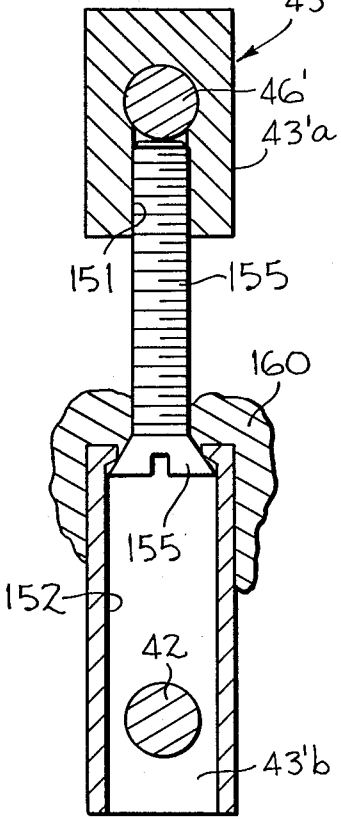
FIG. 9 is a vertical sectional view of the pivotal member of the latch shown in FIG. 8 illustrating the separation of the sections of the pivotal member of the latch after the melting of a melting alloy.

When the temperature surrounding the pivotal member 43' reaches 220° F., in the exemplary embodiment, the sections **43'*a* and 43'*b* are separable and do not function as a unitary structure, because the melting alloy 160 is melted and no longer retains the screw 155 in a fixed position in the opening 152. As a consequence thereof, the sections 43'*a* and 43'*b* become spaced further apart (FIG. 9) to enable the latch plate 37 to be pivotally lifted to a greater extent by the fluid pressure of the bulk material in the shell 10*a* (FIG. 3). The pivotal lifting of the latch plate 37 raises the valve plate 60, the spacer member 61, the yieldable member 70*a*, and the relief backing plate 66 to open the opening 52 in the wall 53 of the shell 10*a* to a greater extent. The volume of the fluid of the bulk material in the shell 10*a* is thereby vented to atmosphere at a greater rate. Thus, the fusible device 43' of the latch 35 serves as part of the relief valve 20. The melting alloy 160 tends to be removed from the pivotal member 43' via the space between the section 43'*b* and the screw 151 under the urgency of the screw head 155*a* (FIG. 9**).

Figure 10:
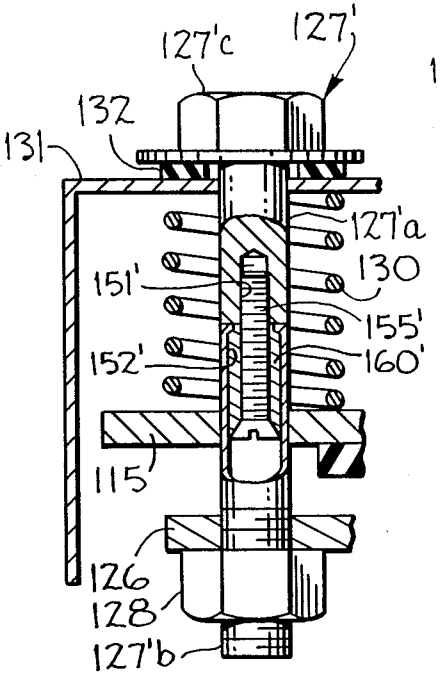
FIG. 10 is a vertical sectional view of a modification of the bolts for the cover employed in the bulk material container shown in FIGS. 4–7 under normal operating conditions.

In FIG. 10 is illustrated a fusible device or a bolt 127', which is a modification of the bolt 127 shown in FIGS. 4–7 for the backing plate 115. In the preferred embodiment, there are three bolts 127' spaced 120 degrees apart. The bolts 127' are received by the bores of the support members 126, respectively. The bolts 127' are supported, respectively, by threaded engagement with the threaded walls surrounding the bores formed in the support members 126, respectively.

Each bolt 127' includes a head **127'*c* that engages the cover 131 through the associated rubber seal 132. There is a nut 128 for each bolt 127' that engages the associated support member 126. The stem of each bolt 127' is received, respectively, by an opening in the cover 131, an opening in the backing plate 115 and an opening in the associated support member 126. Surrounding the stem of each of the bolts 127' is the associated compression coil spring 130, which interengages the lower surface of the cover 131 and the upper surface of the backing plate 115. The compression springs 130 urge the backing plate to seat on the valve seat 106**.

Each bolt 127' is separated into two sections 127'a and 127'b disposed in axially aligned contiguous relation. The section 127'a of each bolt 127' is formed with a head 127'c and the section 127'b of each bolt 127' has a nut 128 in threaded engagement therewith. Formed in the confronting ends of associated sections 127'a and 127'b are suitable complementary openings 151' and 152'. Seated in each of the confronting complementary openings 151' and 152', respectively, is a suitable threaded pin or cap screw 155'. The walls surrounding each of the openings 151' are in threaded engagement with its associated screw 155' to hold the associated screw 155' in a fixed position therein. Disposed within each of the openings 152' about the portion of the cap screw 155' received therein is a melting alloy 160', similar to the melting alloy 160 described therein in detail. The melting alloy 160', while solid, holds the associated screw 155' in a fixed position within the associated opening 152'.

Figure 11:
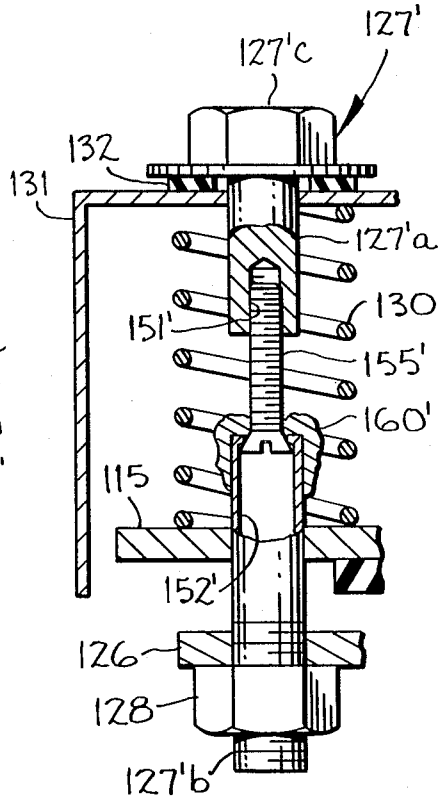
FIG. 11 is a vertical sectional view of a bolt for the cover shown in FIG. 10 illustrating the expansion of the bolt after the melting of a melting alloy.

The screw 155' and the associated melting alloy 160' serve to maintain the sections 127'a and 127'b associated therewrth for each of the bolts 127' in contiguous relation for functioning as a unitary structure. When the temperature surrounding the bolts 127' reaches a predetermined magnitude, the melting alloy 160' melts. As a consequence thereof, the associated sections 127'a and 127'b are no longer secured together and enabling them to be spaced apart (FIG. 11) and enabling the bolt 127' to be expanded. This action enables the backing plate 115 to be lifted to a greater extent by the fluid pressure of the fluid material in the shell 10a. The lifting of the backing plate 115 to a greater extent enables the volume of fluid of bulk material in the shell 10a to be vented to atmosphere at a greater rate. The melting alloy 160' tends to be removed from the associated section 127'b via the space between the section 127'b and the screw 155' (FIG. 11).

What is claimed is:

1. A bulk material container comprising:

(a) a shell for containing fluid under pressure, said shell being formed with a first opening for depositing fluid under pressure in said shell;

(b) a cover for closing said first opening detachably secured to said shell, said cover being formed with a second opening communicating with said first opening formed in said shell;

(c) a valve seat surrounding said second opening;

(d) a displaceable valve plate disposed over said second opening, said valve plate being formed with a first central opening;

(e) a latch mounted on said cover, said latch being formed with a second central opening aligned with said first central opening;

(f) a retaining member supported by said latch and received by said first and second central opening;

(g) a spring surrounding said retaining member and disposed to urge said valve plate toward said valve seat; and (h) a resilient spacer member secured to said valve plate for movement therewith and disposed in displaceable engagement with said valve seat for sealing engagement therewith, said spacer member being formed with a third central opening aligned with said first and second central openings and received by said retaining member, said resilient spacer member maintaining the space between said valve seat and said valve plate relatively constant so as not to adversely effect the seating engagement and the sealing engagement between said valve seat and said spacer member in the event of distortion of said cover, (i) said valve plate and said spacer member being displaced from said valve seat against the urgency of said spring in the event the fluid pressure in said shell exceeds a predetermined magnitude of fluid pressure to vent the fluid under pressure in said shell to atmosphere.

2. A bulk material container as claimed in claim 1 wherein said valve plate and said spacer member are formed with aligned relief apertures, said container further comprising:

(a) a relief backing plate, said relief backing plate being formed with a fourth central opening aligned with said first, second, and third central openings and received by said retaining member; and (b) a yieldable member disposed between said resilient spacer member and said relief backing plate in sealing engagement with said spacer member, said yieldable member being formed with a fifth central opening aligned with said first, second, third and fourth central openings and received by said retaining member, said yieldable member extending outwardly from said retaining member a distance greater than the location of said aligned relief apertures for closure of said aligned relief apertures, said relief backing plate extending outwardly from said retaining member a distance lesser than the outermost location of said aligned relief apertures, said yieldable member maintaining a closure of said aligned relief apertures while the fluid pressure in said shell is greater than atmospheric pressure, said yieldable member being displaced away from said spacer member in the event the fluid pressure in said shell is less than atmospheric pressure for air under atmospheric pressure to enter said shell.

3. A bulk material container as claimed in claim 2 and comprising a reinforcing member disposed between said cover and said latch, said reinforcing member being formed with apertures for the passage of fluid under pressure from said shell to atmosphere and for the passage of air under atmospheric pressure into said shell through said relief apertures.

4. A bulk material container as claimed in claim 3 wherein said latch at one end thereof is pivotally attached to said cover, said latch at the other end thereof includes a restraining mechanism connected to said cover for removably locking said latch over said second opening with said spacer member in sealing engagement with said valve seat, pivotal movement of said latch moves in unison therewith said valve plate, said retaining member, said spring, said spacer member, said relief backing plate and said yieldable member.

5. A bulk material container as claimed in claim 4 wherein said reinforcing member is secured to said latch and the pivotal movement of said latch imparts therewith movement to said reinforcing member.

6. A manhole cover for a bulk material container, said manhole cover being formed with an opening therethrough and comprising:

(a) a valve seat surrounding said opening in said manhole cover;

(b) a movable valve plate disposed over said opening in said manhole cover, said valve plate being formed with a first central opening;

(c) a resilient spacer member secured to said valve plate for movement therewith and disposed in displaceable engagement with said valve seat for sealing engagement therewith, said spacer member being formed with a second central opening aligned with said first central opening;

(d) a retaining member received by said first central opening of said movable valve plate and a second central opening of said spacer member;

(e) a spring surrounding said retaining member in engagement with said movable valve plate for urging said movable valve plate and said spacer member toward said valve seat for sealing engagement between said spacer member and said valve seat; and (f) a latch attached to said cover, said latch having a third central opening therethrough aligned with said first and second central opening for receiving said retaining member, said latch supporting said retaining member and said valve plate supporting said spring surrounding said retaining member, (g) said spacer member maintaining the space between said valve set and said valve plate relatively constant so as not to adversely effect the seating engagement and the sealing engagement between said valve seat and said spacer member in the event of distortion of said cover, (h) said valve plate and said spacer member being displaced from said valve seat against the urgency of said spring in the event fluid pressure applied against said spacer member and said valve plate exceeds a predetermined magnitude of fluid pressure.

7. A manhole cover as claimed in claim 6 wherein said valve plate and said spacer member are formed with aligned relief apertures, said manhole cover further comprising:

(a) a relief backing plate, said relief backing plate being formed with a fourth central opening aligned with said first, second and third central openings and received by said retaining member; and (b) a yieldable member disposed between said resilient spacer member and said relief backing plate in sealing engagement with said spacer member when the fluid pressure applied against said yieldable member in one direction is at least atmospheric pressure, said yieldable member being formed with a fourth central opening aligned with said first, second, third and fourth central openings and received by said retaining member, said yieldable member extending outwardly from said retaining member a distance greater than the location of said aligned relief apertures for closure of said aligned relief apertures, said relief backing plate extending outwardly from said retaining member a distance lesser than the outermost location of said aligned relief apertures, said yieldable member maintaining a closure of said aligned relief apertures while fluid pressure applied to said yieldable member in said one direction is at least atmospheric pressure, said yieldable member being displaced away from said spacer member in the event fluid pressure applied to said yieldable member in said one direction is less than atmospheric pressure for air under atmospheric pressure to pass through said aligned relief apertures.

8. A manhole cover as claimed in claim 7 and comprising a reinforcing member disposed between said cover and said support means, said reinforcing means being formed with apertures for the passage of fluid under pressure to atmosphere and the passage of air under atmospheric pressure through said relief apertures.

9. A manhole cover as claimed in claim 8 wherein said latch at one end thereof is pivotally attached to said cover, said latch at the other end thereof includes a restraining mechanism connected to said cover for removably locking said latch over said opening with said spacer member in sealing engagement with said valve seat, pivotal movement of latch moves in unison therewith said valve plate, said retaining member, said spring, said spacer member, said relief backing plate and said yieldable member.

10. A manhole cover as claimed in claim 9 wherein said reinforcing member is secured to said latch and the pivotal movement of said latch imparts therewith movement to said reinforcing member.

11. A bulk material container comprising:

(a) a shell with an opening therein for the deposit of fluid under pressure into said shell;

(b) a valve seat supported by said shell and surrounding said opening of said shell;

(c) a movable valve plate disposed over said valve seat and over said opening of said shell, said valve plate being formed with a plurality of peripheral openings in the vicinity of the periphery of said valve plate, said peripheral openings being spaced apart generally equal angular distances;

(d) an outer resilient sealing member fixed to said valve plate for seating on said valve seat and for sealing engagement with said valve seat;

(e) a plurality of peripheral retaining members received by said peripheral openings, respectively, and supported by said shell;

(f) a plurality of compression coil springs surrounding said peripheral retaining members, respectively, and disposed to urge said valve plate toward said valve seat, (g) said valve plate being displaced from said valve seat against the urgency of said compression springs when the fluid pressure in said shell exceeds a predetermined magnitude for venting the fluid under pressure in said shell to the atmosphere.

12. A bulk material container as claimed in claim 11 wherein said movable valve plate is formed with a central opening and a plurality of relief apertures, said container further comprising:

(a) a movable inner resilient sealing member disposed below said valve plate for sealing engagement therewith, said inner resilient sealing member extending below said relief apertures for closure thereof, said inner resilient sealing member being formed with a central opening aligned with the central opening of said valve plate;

(b) a backing plate disposed below said inner resilient sealing member for maintaining said inner sealing member generally planar, said backing plate being formed with a central opening aligned with the central opening of said valve plate and said inner sealing member;

(c) a central retaining member received by said central openings of said valve plate, said inner sealing member and said backing plate, said central retaining member supporting said backing plate and said inner resililent sealing member; and (d) an extension coil spring surrounding said central retaining member to urge said valve plate and said inner sealing member in sealing engagement, (e) said inner sealing member being displaced from said valve plate against the urgency of said extension spring in the event the fluid pressure in said shell is less than atmospheric pressure, the displacement of said inner sealing member from said valve plate enables air under atmospheric pressure to enter said shell through said relief apertures to lessen the degree of vacuum in said shell.

13. A bulk material container as claimed in claim 11 and comprising means secured to said shell and formed with openings therein to receive said peripheral retaining members, respectively, for supporting the same, said means further forming said valve seat.

14. A bulk material container as claimed in claim 12 and comprising means secured to said shell and formed with openings therein to receive said peripheral retaining members, respectively, for supporting the same, said means further forming said valve seat.

15. A bulk material container as claimed in claim 1 wherein said latch at one end thereof is pivotally attached to said cover, said latch at the other end thereof includes a restraining mechanism connected to said cover for removably locking said latch over said second opening with said spacer member in sealing engagement with said valve seat, said restraining mechanism comprising a fusible device meltable at a predetermined temperature for enabling fluid under pressure in said shell to pivotally move said latch away from said valve seat, the pivotal movement of said latch away from said valve seat moves said valve plate and said spacer member away from said valve seat for enabling fluid under pressure to vent to atmosphere.

16. A bulk material container as claimed in claim 4 wherein said restraining mechanism comprises a fusable device meltable at a predetermined temperature for enabling fluid under pressure in said shell to pivotally move said latch away from said valve seat, the pivotal movement of said latch away from said valve seat moves therewith said valve plate, said spacer member, said relief backing plate and said yieldable member.

17. A manhole cover for bulk material container as claimed in claim 6 wherein said latch at one end thereof is pivotally attached to said cover, said latch at the other end thereof includes a restraining mechanism connected to said cover for removably locking said latch over said opening of said cover with said spacer member in sealing engagement with said valve seat, said restraining mechanism comprising a fusible device meltable at a predetermined temperature for enabling said latch to pivotally move away from said valve seat, the pivotal movement of said latch away from said valve seat moves said valve plate and said spacer member away from said valve seat for enabling fluid under pressure to vent to atmosphere.

18. A manhole cover for a bulk material container as claimed in claim 9 wherein said restraining mechanism comprises a fusible device meltable at a predetermined temperature for enabling said latch to pivotally move away from said valve seat, the pivotal movement of said latch away from said valve seat moves therewith said valve plate, said spacer member, said relief backing plate and said yieldable member.

19. A bulk material container as claimed in claim 15 wherein said fusible device comprises:

(a) a pivotal member having separable sections, each of said separable sections being formed with confronting openings, (b) a threaded element received by said confronting openings of said pivotal member, a portion of said threaded element being fixedly disposed in one of said confronting openings, another portion of said threaded element being disposed in the other of said confronting openings, and (c) a melting alloy disposed in said other confronting opening for retaining said threaded element in said other confronting opening until said melting alloy is melted at said predetermined temperature.

20. A manhole cover for a bulk material container as claimed in claim 18 wherein said fusible device comprises:

(a) a pivotal member having separable sections, each of said separable sections being formed with confronting openings, (b) a threaded element received by said confronting openings of said pivotal member, a portion of said threaded element being fixedly disposed in one of said openings, another portion of said threaded element being disposed in the other of said openings, and (c) a melting alloy disposed in said other opening for retaining said threaded element in said other opening until said melting alloy is melted at said predetermined temperature.

21. A manhole cover for a bulk material container, said manhole cover being formed with an opening therethrough and comprising:

(a) a valve seat surrounding said opening in said manhole cover;

(b) a movable valve plate disposed over said valve seat and said opening in said manhole cover, said valve plate being formed with an opening;

(c) a retaining member received by said opening of said movable valve plate;

(d) a spring surrounding said retaining member in engagement with said movable valve plate for urging said movable valve plate toward said valve seat for sealing engagement with said valve seat; and (e) a latch attached to said cover, said latch having a third central opening therethrough aligned with said first and second central opening for receiving said retaining member, said latch supporting said retaining member and said valve plate supporting said spring surrounding said retaining member, (f) said valve plate being displaced from said valve seat against the urgency of said spring in the event fluid pressure applied against said valve plate exceeds a predetermined magnitude of fluid pressure, (g) said latch at one end thereof being pivotally attached to said cover, said latch at the other end thereof including a restraining mechanism connected to said cover for removably locking said latch over said opening of said cover in sealing engagement with said valve seat, said restraining mechanism comprising a fusible device meltable at a predetermined temperature for enabling said latch to pivotally move away from said valve seat, the pivotal movement of said latch away from said valve seat moves said valve plate further away from said valve seat for enabling an increased volume of fluid under pressure to vent to atmosphere.

22. A manhole cover as claimed in claim 21 wherein said fusible device comprises:

(a) a pivotal member having separable sections, each of said separable sections being formed with confronting openings, (b) a threaded element received by said confronting openings of said pivotal member, a portion of said threaded element being fixedly disposed in one of said confronting openings, another portion of said threaded element being disposed in the other of said confronting openings, and (c) a melting alloy disposed in said other confronting opening for retaining said threaded element in said other confronting opening until said melting alloy is melted at said predetermined temperature.

23. A manhole cover for a bulk material container, said manhole cover being formed with an opening therethrough and comprising:

(a) a valve seat surrounding said opening of said cover;

(b) a movable valve plate disposed over said valve seat and over said opening of said cover, said valve plate being formed with a plurality of peripheral openings in the vicinity of the periphery of said valve plate, said peripheral openings being spaced apart generally equal angular distances;

(c) a plurality of peripheral retaining members received by said peripheral openings, respectively;

(d) a plurality of compression coil springs surrounding said peripheral retaining members, respectively, and disposed to urge said valve plate toward said valve seat, (e) said valve plate being displaced from said valve seat against the urgency of said compression springs when fluid pressure applied to said valve plate exceeds a predetermined magnitude for venting the fluid under excessive pressure to the atmosphere, (f) each of said retaining members comprising separable sections formed with confronting openings, a threaded element received by each of said confronting openings of said separable sections, respectively, a portion of each of said threaded elements being fixedly disposed in one of said associated confronting openings, another portion of each of said threaded elements being disposed in the other of said associated confronting openings, and a melting alloy disposed in each of said other confronting openings, respectively, for retaining said threaded elements in their other associated confronting opening until said melting alloys are melted at a predetermined temperature for enabling said separable sections to separate for moving said valve plate from said valve seat, the movement of said valve plate away from said valve seat increases the extent of said valve plate from said valve seat to enable increased volume of fluid under excessive pressure to vent to atmosphere.

* * * * *

UNITED STATES PATENT OFFICE

CERTIFICATE OF CORRECTION

Patent No. 4,768,675 Dated September 6, 1988

Inventor(s) CLARENCE B. COLEMAN

It is certified that error appears in the above-identified patent and that said Letters Patent are hereby corrected as shown below:

Column 8, line 50, change "151" to ---155---;

Column 11, line 26, change "set" to ---seat---;

Column 12, line 5, change "support means" to ---latch---.

Signed and Sealed this

Twenty-fourth Day of January, 1989

*Attest:*

DONALD J. QUIGG

*Attesting Officer*

*Commissioner of Patents and Trademarks*